US008194104B2

(12) United States Patent
Suzuki et al.

(10) Patent No.: US 8,194,104 B2
(45) Date of Patent: Jun. 5, 2012

(54) LIQUID-CRYSTAL DISPLAY DEVICE AND DRIVE CONTROL CIRCUIT

(75) Inventors: Toshiaki Suzuki, Tokyo (JP); Kazuhiro Nukiyama, Tokyo (JP); Tsuyoshi Kamada, Tokyo (JP)

(73) Assignee: Sony Corporation, Tokyo (JP)

( * ) Notice: Subject to any disclaimer, the term of this patent is extended or adjusted under 35 U.S.C. 154(b) by 338 days.

(21) Appl. No.: 12/593,725

(22) PCT Filed: Mar. 28, 2008

(86) PCT No.: PCT/JP2008/056125

§ 371 (c)(1),
(2), (4) Date: Sep. 29, 2009

(87) PCT Pub. No.: WO2008/123427

PCT Pub. Date: Oct. 16, 2008

(65) Prior Publication Data

US 2010/0118061 A1 May 13, 2010

(30) Foreign Application Priority Data

Mar. 29, 2007 (JP) ..... 2007-089255

(51) Int. Cl.
*G09G 5/10* (2006.01)

(52) U.S. Cl. ..... 345/690; 345/87

(58) Field of Classification Search ..... None
See application file for complete search history.

(56) References Cited

U.S. PATENT DOCUMENTS

| | | | |
|---|---|---|---|
| 2003/0146893 | A1 | 8/2003 | Sawabe |
| 2005/0184944 | A1 | 8/2005 | Miyata et al. |
| 2005/0253797 | A1 | 11/2005 | Kamada et al. |
| 2007/0018930 | A1 | 1/2007 | Do et al. |
| 2007/0024559 | A1 | 2/2007 | Ahn et al. |
| 2008/0024409 | A1 | 1/2008 | Tomizawa et al. |

FOREIGN PATENT DOCUMENTS

| | | |
|---|---|---|
| JP | 2003 295160 | 10/2003 |
| JP | 2005 234552 | 9/2005 |
| JP | 2005 316211 | 11/2005 |
| WO | WO 2006/098247 A1 | 9/2006 |
| WO | 2006 049245 | 11/2006 |

OTHER PUBLICATIONS

Supplementary European Search Report issued on Apr. 1, 2011 in corresponding European Application No. 08 73 9243.

*Primary Examiner* — Paul Huber
(74) *Attorney, Agent, or Firm* — Oblon, Spivak, McClelland, Maier & Neustadt, L.L.P.

(57) ABSTRACT

In a case where each of pixels of a liquid-crystal display panel is divided into two subpixels, the drive levels of the subpixels with respect to the gradation of an input video signal can be selected from among a plurality of drive levels while an increase in the circuit scale is suppressed.

Thus, in the present invention, a first subpixel driving level converter for, on the basis of the gradation value of each pixel of the input video signal, obtaining a first gradation value for driving a first subpixel is provided, and the first subpixel is driven and controlled on the basis of the first gradation value. Then, the first gradation value obtained by the first subpixel driving level converter is converted into a luminance value, and a difference with the luminance value such that the gradation values of the whole pixels are converted is obtained. The obtained difference is converted into a gradation value, and a second gradation value for driving a second subpixel is obtained. The second subpixel is driven and controlled on the basis of the second gradation value.

10 Claims, 13 Drawing Sheets

LIQUID-CRYSTAL DISPLAY DEVICE AND DRIVE CONTROL CIRCUIT

This application is a 371 of PCT/JP2008/056125, filed Mar. 28, 2008.

TECHNICAL FIELD

The present invention relates to a drive control circuit for controlling the driving of a liquid-crystal display panel in which each of pixels is divided into two subpixels. Also, the present invention relates to a liquid-crystal display device in which each of pixels of a liquid-crystal display panel is divided into two subpixels.

BACKGROUND ART

It is known that, as field of view angle characteristics of a liquid-crystal display device, when the screen is viewed obliquely, a reverse phenomenon occurs such that, as a result of the fact that after the luminance temporarily increases with an increase in the gradation, the luminance is decreased, the luminance increases in an area of a lower gradation than in an area of a higher gradation.

In order to improve such field of view angle characteristics, hitherto, a technology in which each of pixels of a liquid-crystal display panel is divided into two subpixels has been proposed (see, for example, Japanese Unexamined Patent Application Publication No. 2005-316211 published by Japan Patent Office). In this technology, as shown as an example in FIG. 1, a display electrode for one pixel P (a pixel for each of R, G, and B, which are the three primary colors) of a liquid-crystal display panel 50 is divided into electrodes of two subpixels A and B that are driven by a data driver 60 independently of each other.

Then, by setting the driving level (gradation at which the subpixels A and B are driven) of the subpixels A and B to mutually different gradations on the basis of the gradation of the input video signal, the luminance characteristics in a case where the whole pixels P are viewed obliquely are made to approach the luminance characteristics in a case where the whole pixels P are from the front.

In Japanese Unexamined Patent Application Publication No. 2005-316211, which is the above-described document, as such a method of setting drive levels of subpixels, it is described that a gradation conversion table in which the gradation of an input video signal is associated with the output gradation of each subpixel is provided.

Incidentally, in a liquid-crystal display device in which each pixel of a liquid-crystal display panel is divided into two subpixels in the manner described above, in order that the balance of the luminances of R, G, and B when viewed obliquely is improved, there is a case in which it is desirable that the drive level of the subpixel be changed in accordance with whether the pixel is R, G, or B.

FIG. 2 shows an example of such a case. In FIG. 2(*a*), gradation-luminance characteristics in a case where the drive levels of the subpixels A and B with respect to the input gradation is set as in FIG. 2(*b*) and the screen is viewed from the front are depicted as GL11. Also, gradation-luminance characteristics in a case where the drive levels of the subpixels A and B are set as in FIG. 2(*b*) and the screen is viewed obliquely (angle θ) are depicted as GL12.

Here, for example, the gradation values of R, G, and B are assumed to be 128, 96, and 64, respectively. In FIG. 2(*a*), also, such gradation values of R, G, and B are depicted. In that case, between the gradation-luminance characteristics GL11 and GL12, the ratio of the luminance of R, G, and B when viewed from the front is about 1:2:5, and the ratio of the luminance of R, G, and B when viewed obliquely is about 5:7:10. As a result, when viewed obliquely, since the ratio of the luminance of R becomes small, the red color becomes dark.

In FIG. 2(*a*), the drive levels of the subpixels A and B with respect to the input gradation are set so as to differ from those of FIG. 2(*b*) (here, so the gradation values become equal as in FIG. 2(*c*)), so that gradation-luminance characteristics when the screen is viewed from the angle θ described above are also depicted as GL13. In the gradation-luminance characteristics GL13, the luminance when the gradation value is 128 is higher than that of the gradation-luminance characteristics GL12.

Accordingly, if the drive levels of the subpixels shown in FIG. 2(*b*) are selected with respect to the pixels of G and B, and the drive level of the subpixel shown in FIG. 2(*c*) is selected with respect to only the pixel of R, the ratio of the luminance of R when viewed obliquely is increased (the ratio of the luminances of R, G, and B is approached when viewed from the front). As a consequence, it is possible to improve the balance of the luminances of R, G, and B when viewed obliquely.

FIG. 2 shows two sets of gradation values in FIG. 2(*b*) and FIG. 2(*c*). If the drive levels of the subpixels for each of the pixels of R, G, and B are selected correspondingly from among three or more types of drive levels shown as an example in FIG. 3, it is possible to even further improve the balance of the luminances of R, G, and B when viewed obliquely.

However, as described in Patent Document 1 described above, in the method in which a gradation conversion table in which input gradations are associated with output gradations so as to allow setting of the drive levels of the subpixels, in order to be able to select a driving level from among a plurality of drive levels, it is necessary to provide a separate gradation conversion table for each driving level. As a result, as shown as an example in FIG. 4, as the number of selectable drive levels is increased, the number of gradation conversion tables for the subpixels A and B increases like TA11 and TB11, TA12 and TB12, . . . TAm and TBm.

Then, in recent years, since the resolution of the gradation has been increasingly improved so as to improve display performance, the amount of data of one individual gradation conversion table is increased. Provision of many such gradation conversion tables with a large amount of data causes the circuit scale of a RAM for storing gradation conversion tables, or the like to increase.

Further, here, the problem in the case that the driving level is selected from among a plurality of drive levels in accordance with whether the pixel is R, G, or B has been described. Still the same problem also occurs even in a case where, for example, the drive level of a subpixel is selected from among a plurality of drive levels on the basis of the type of the input video signal.

In view of the above-described points, it is an object of the present invention to be capable of selecting the drive level of a subpixel with respect to the gradation of an input video signal from among a plurality of drive levels while suppressing an increase in the circuit scale in a liquid-crystal display device in which each pixel of a liquid-crystal display panel is divided into two subpixels.

DISCLOSURE OF INVENTION

In order to achieve the above-described object, the present invention provides a drive control circuit including:

a first subpixel driving level converter for obtaining, on the basis of a gradation value of each of pixels of an input video signal, a first gradation value for driving a first subpixel among the first and second subpixels arranged in each pixel of a liquid-crystal display panel;

a first luminance value converter for converting a gradation value for driving the first subpixel, the gradation value being converted by the first subpixel driving level converter, into a luminance value;

a second luminance value converter for converting the gradation value of each pixel of the input video signal into a luminance value;

a subtraction unit for calculating a difference between the luminance value converted by the second luminance value converter and the luminance value converted by the first luminance value converter; and a second subpixel driving level converter for converting the luminance value of the difference subtracted by the subtraction unit into a gradation value and obtaining a second gradation value for driving the second subpixel, and a liquid-crystal display device including the drive control circuit.

In such present invention, in such a manner as to correspond to the gradation of the input video signal, information on the gradation of the first subpixel among the first and second subpixels such that each pixel is divided is obtained by the first subpixel driving level converter. On the basis of the gradation value of the first subpixel obtained by the first subpixel driving level converter, the first subpixel is driven and controlled.

Furthermore, the gradation value of the first subpixel obtained by the first subpixel driving level converter is converted into a luminance value of the first subpixel by the first luminance value converter. In addition, the luminance that is the target as the whole pixels corresponding to the gradation of the input video signal is obtained by the second luminance value converter. Then, the subtraction unit subtracts the luminance of the first subpixel from the luminance that is the target as the whole pixels, thereby obtaining the luminance of the second subpixel. On the basis of the gradation value of the second subpixel obtained by the second subpixel driving level converter, the second subpixel is driven and controlled.

In this case, if the conversion characteristics obtained by the first subpixel driving level converter are changed only, the luminance to be generated by the first luminance value converter will be changed. For this reason, since the difference supplied from the subtraction unit to the second subpixel driving level converter is changed, it is possible to change the drive levels of the two subpixels with respect to the gradation of the input video signal. That is, it is possible to increase the number of selectable drive levels of the subpixels by only increasing variations of the conversion characteristics by the first subpixel driving level converter while the first and second luminance value converters and the second subpixel driving level converter, which perform conversion of characteristics between the gradation and the luminance, are fixed without change.

Therefore, if this drive control circuit is installed into a liquid-crystal display device in which each pixel of a liquid-crystal display panel is divided into two subpixels, it becomes possible to select the drive level of a subpixel with respect to the gradation of an input video signal from among a plurality of drive levels while an increase in the circuit scale is suppressed.

BEST MODE FOR CARRYING OUT THE INVENTION

Figure 5:
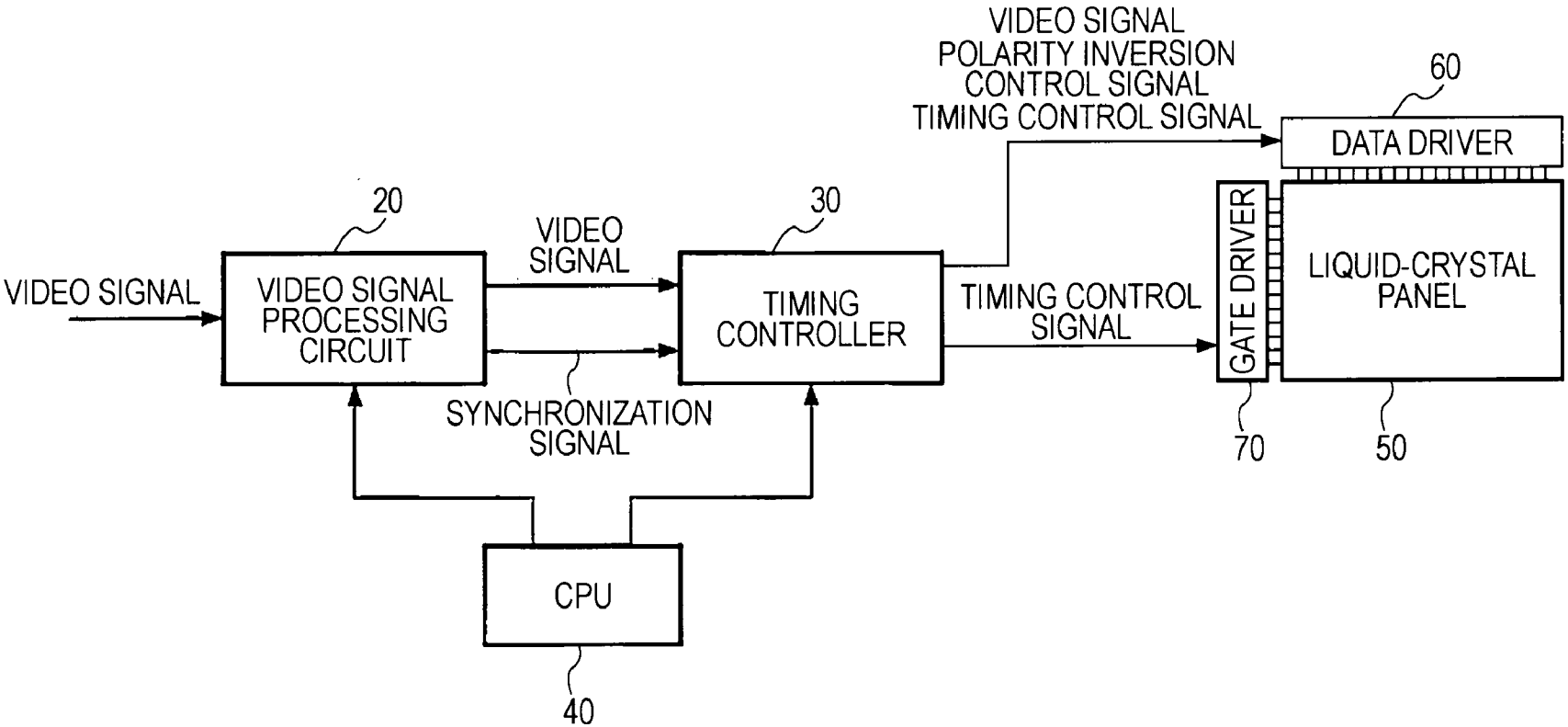
FIG. 5 is a block diagram showing the outline of a circuit configuration of a liquid-crystal display device to which an embodiment of the present invention is applied.

An exemplary embodiment of the present invention will be described below specifically with reference to the attached drawings. FIG. 5 is a block diagram showing the outline of a circuit configuration of a liquid-crystal display device to which an exemplary embodiment is applied. The liquid-crystal display device is provided with a video signal processing circuit 20, a timing controller 30, a CPU 40 for controlling the video signal processing circuit 20 and the timing controller 30, a liquid-crystal display panel 50, a data driver (data-line driving circuit) 60 for driving the liquid-crystal display panel 50, and a gate driver (scanning-line driving circuit) 70.

A video signal input to the liquid-crystal display device from the outside is sent to the video signal processing circuit 20. In the video signal processing circuit 20, processing, such as extraction of a synchronization signal, IP conversion (conversion from a signal of an interlace method into a signal of a progressive method), scaling (image size conversion in accordance with the resolution of a liquid-crystal panel), or the like, is performed on the input video signal. Then, the video signal that has undergone the processing of the video signal processing circuit 20 and the synchronization signal extracted by the video signal processing circuit 20 are sent to the timing controller 30.

The timing controller 30, as is well known, supplies a video signal (gradation signal), a polarity inversion control signal, and a timing control signal to the data driver 60, and also supplies a timing control signal to the gate driver 70, thereby controlling the driving of the liquid-crystal display panel 50.

Figure 1:
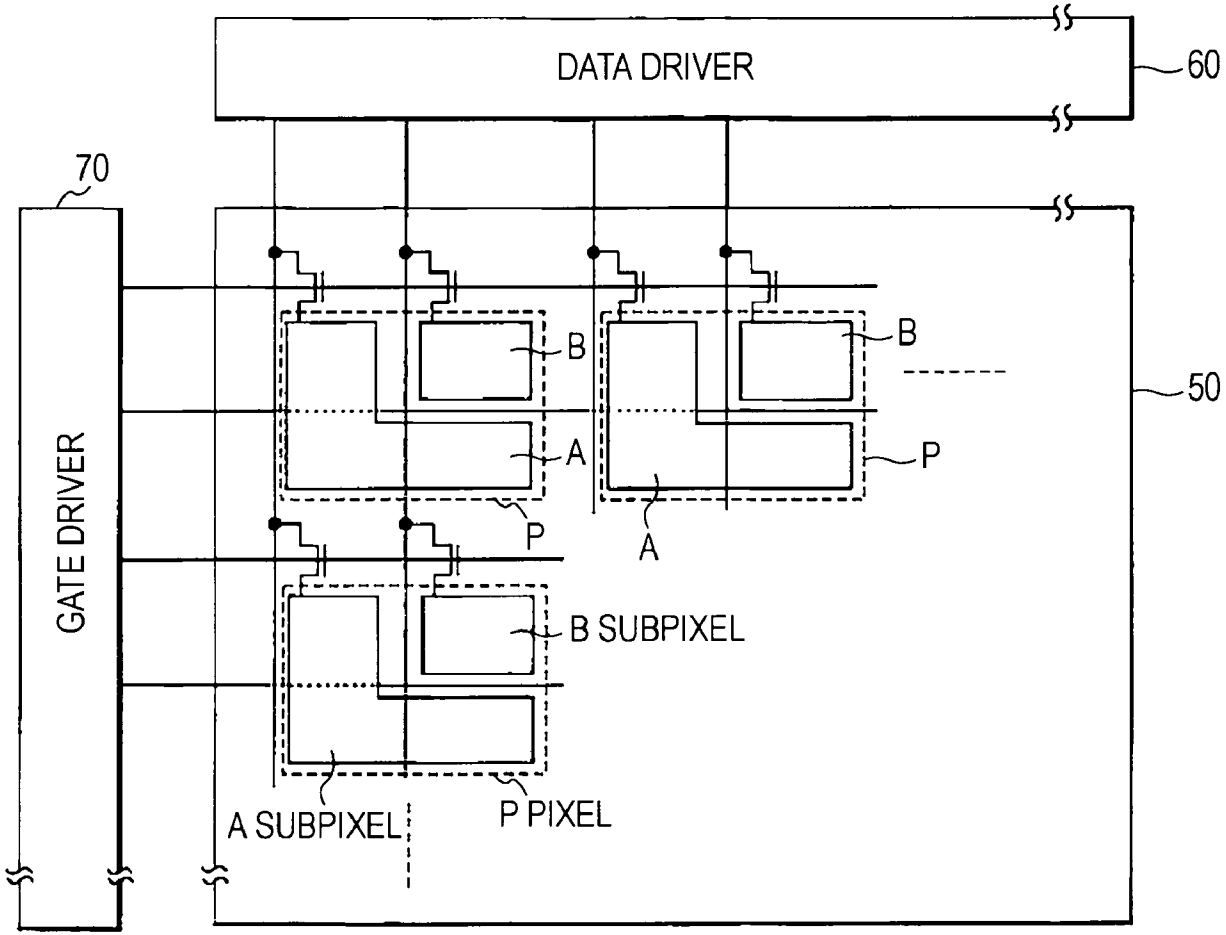
FIG. 1 is a panel diagram showing the outline of the configuration of a liquid-crystal display panel in which each of pixels is divided into two subpixels.

The liquid-crystal display panel 50 is such that, like the liquid-crystal panel shown as an example using the same reference numeral in FIG. 1, a display electrode for one pixel P (pixel) for each of R, G, and B, which are the three primary colors), is divided into electrodes of two subpixels A and B. The data driver 60 drives the two subpixels A and B independently of each other like the data driver indicated using the same reference numeral in FIG. 1.

Figure 6:
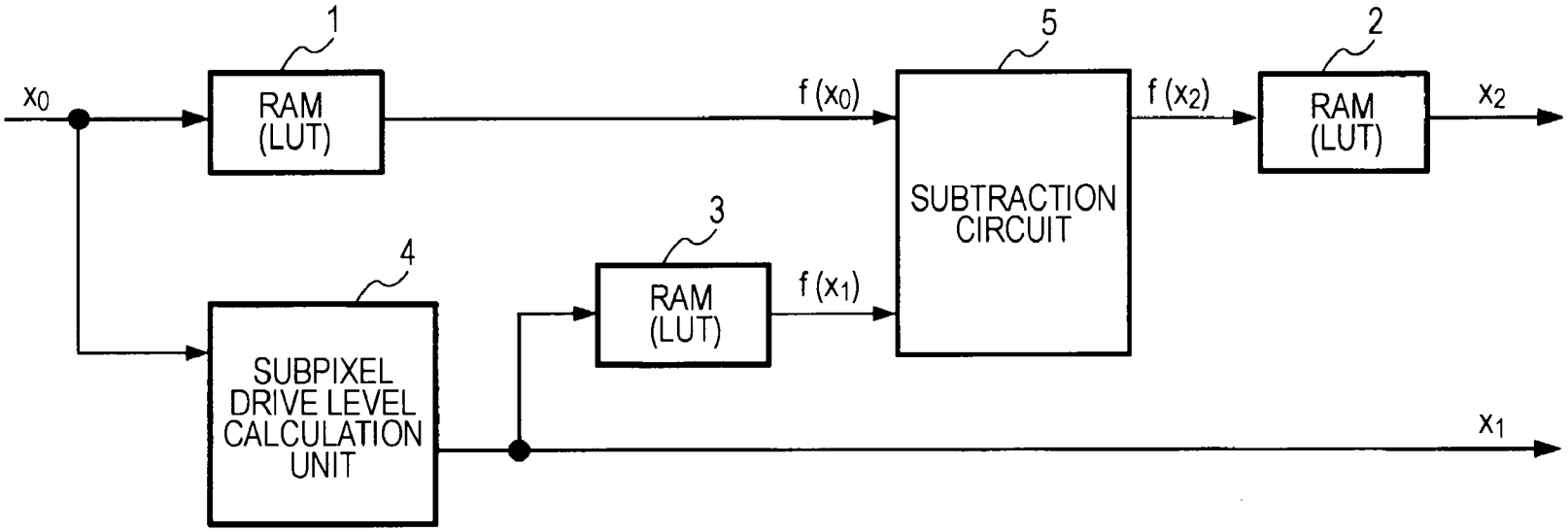
FIG. 6 is a block diagram showing the configuration of a circuit for generating a gradation signal, within a timing controller of FIG. 5.

The timing controller 30 has a function of generating a gradation signal to be supplied to the data driver 60. FIG. 6 is a block diagram showing the configuration of a circuit for generating this gradation signal, within the internal configuration of the timing controller 30. A RAM 1, a RAM 2, a RAM 3, a subpixel drive level calculation unit 4, and a subtraction circuit 5 are provided.

Figure 7:
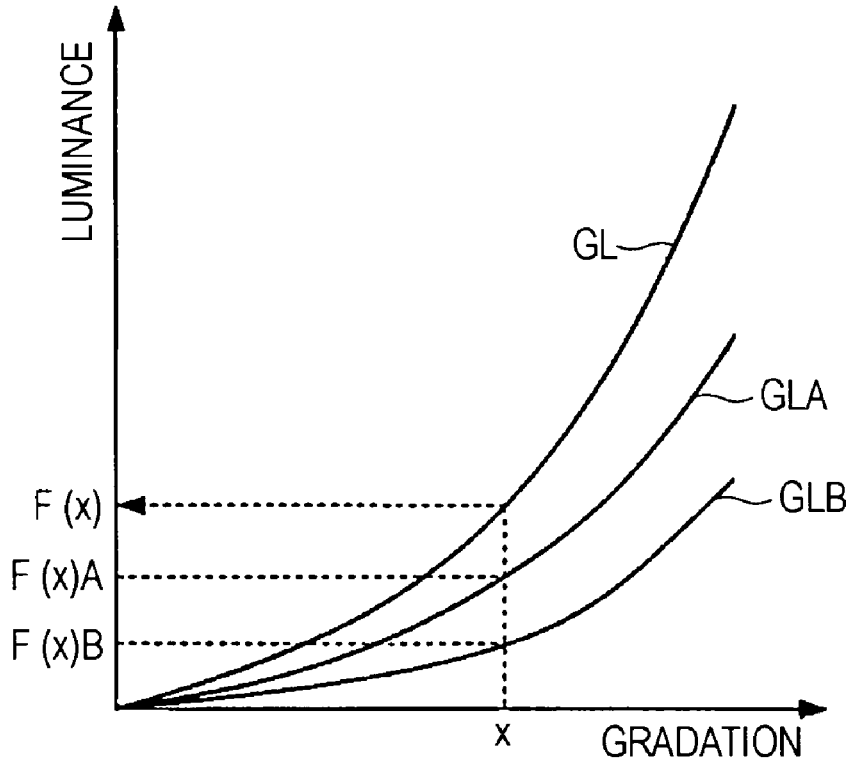
FIG. 7 is a characteristic view showing gradation-luminance characteristics represented using a look-up table within each RAM of FIG. 6.

The RAM 1 functions as a converter for converting the gradation values of the whole pixels into luminance values. The RAM 1 is stored with a look-up table (LUT) in which the gradation values and the luminance values are associated with each other so that the gradation-luminance characteristics GL shown in FIG. 7 are represented as target gradation-luminance characteristics (also referred to as "target characteristics") when the whole pixels P (FIG. 1) are viewed from the front of the screen.

The RAM 2 functions as a converter for converting the luminance value of one of the subpixels A into a gradation value. The RAM 2 is stored with a look-up table in which the gradation values and the luminance values are associated with each other so that the gradation-luminance characteristics GLA shown in FIG. 7 are shown as the gradation-luminance characteristics of the subpixel A for realizing the target characteristics GL shown in FIG. 7.

The RAM 3 functions as a converter for converting the gradation value of the other subpixel B into a luminance value. The RAM 3 is stored with a look-up table in which the gradation values and the luminance values are associated with each other so that the gradation-luminance characteristics GLB shown in FIG. 7 are shown as the gradation-luminance characteristics of the subpixel B for realizing the target characteristics GL shown in FIG. 7.

Regarding the gradation-luminance characteristics GLA and the gradation-luminance characteristics GLB, the ratio of the luminance value corresponding to the same gradation value (for example, the ratio of the luminance value f(x)A to the f(x)B corresponding to the gradation value x in the figure) is equal to the ratio of the area of the subpixel A to that of the subpixel B. Furthermore, regarding the gradation-luminance characteristics GLA and the gradation-luminance characteristics GLB, the value (for example, f(x)A+f(x)B in the figure) such that the luminance values corresponding to the same gradation value are added is equal to the luminance value (f(x) in the figure) of the target characteristics GL corresponding to the gradation value.

The subpixel drive level calculation unit 4, under the control of the CPU 40 (FIG. 5), calculates the gradation value of the subpixel B (FIG. 1) corresponding to the gradation value of the video signal to be input to the timing controller 30. For the configuration of the subpixel drive level calculation unit 4, any one of the configuration examples described below may be adopted.

<Configuration Example Based on Calculation of Subpixel Drive Level Calculation Unit 4>

First, a description will be given of an example in which the subpixel drive level calculation unit 4 is formed by a calculation circuit for multiplication or the like.

Figure 8:
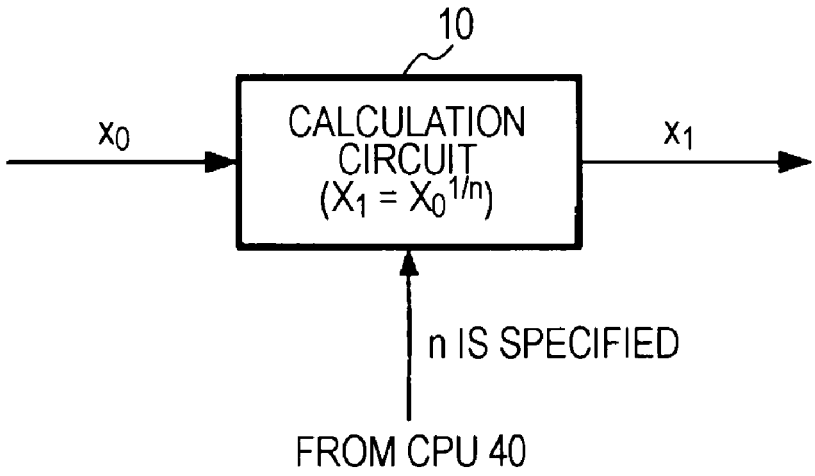
FIG. 8 is a configuration diagram showing an example of the configuration of a subpixel drive level calculation unit.

For example, as shown in FIG. 8, the subpixel drive level calculation unit 4 is formed by a calculation circuit 10 that sets the gradation value of the video signal to be input to the timing controller 30 to x0 and performs power calculation of $$x1=x0^{1/n},$$

and a calculation result $x_1$ thereof is used as the gradation value of the subpixel B. In the case of this configuration example, the CPU 40 supplies a control signal that specifies the value of this n (may not be an integer) to the calculation circuit 10.

Figure 3:
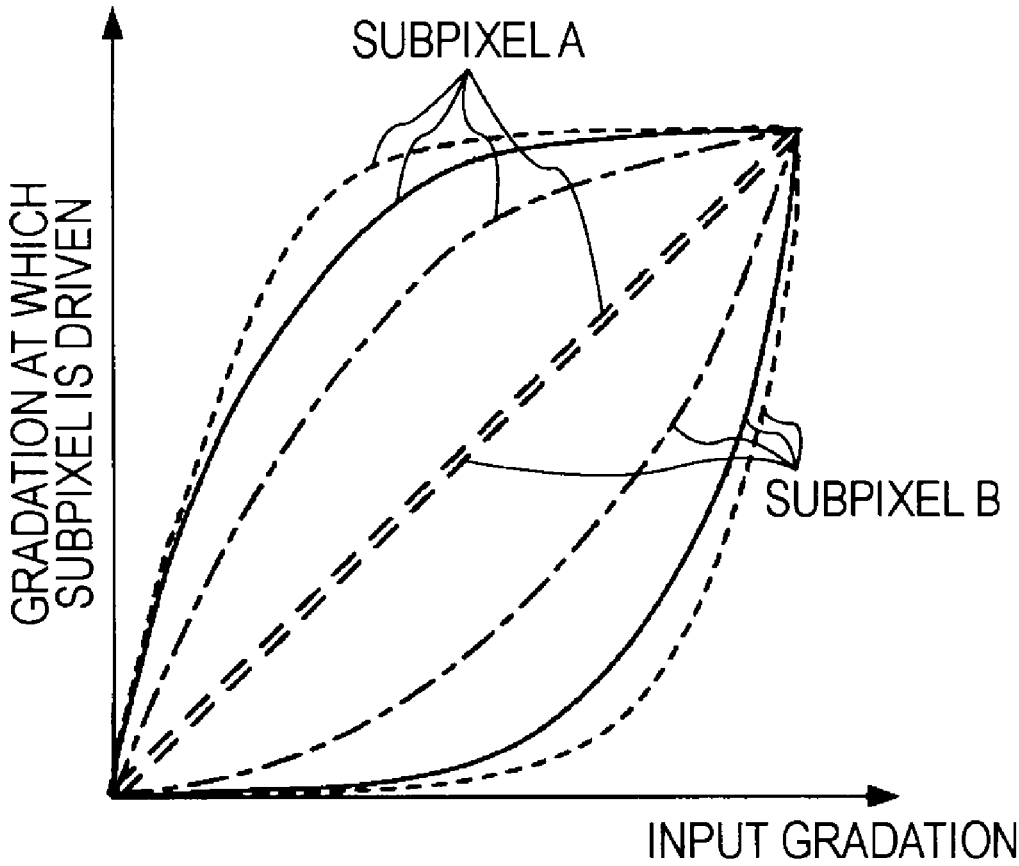
FIG. 3 is a characteristic view showing as an example three or more types of drive levels of subpixels.
Figure 9:
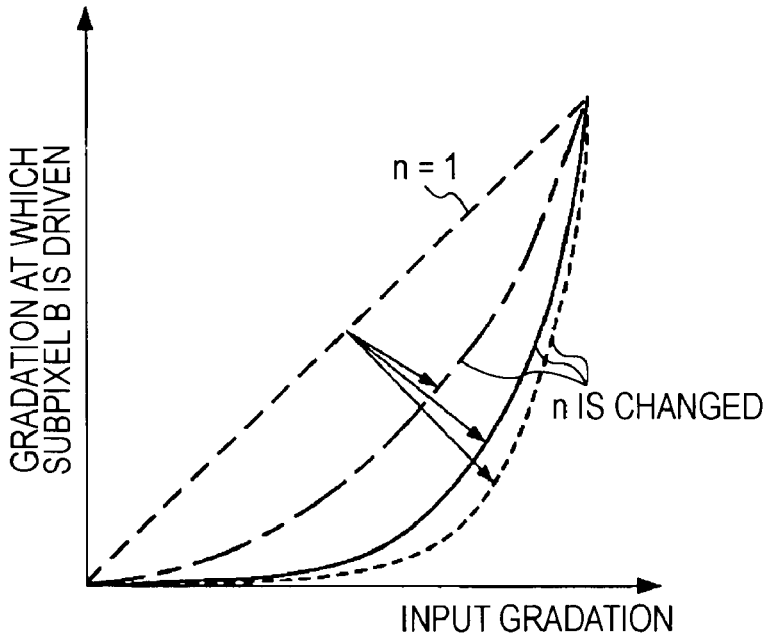
FIG. 9 is a characteristic view showing an example of the state of changes in the drive level of a subpixel B by a calculation circuit of FIG. 8.

FIG. 9 shows as an example the drive levels of the subpixel B with respect to the gradation of an input video signal in a case where the value of this n is changed in two or more ways. By changing the value of n in two or more ways, it is possible to change the drive level of the subpixel B in two or more ways similarly to that shown as an example in FIG. 3.

Figure 10:
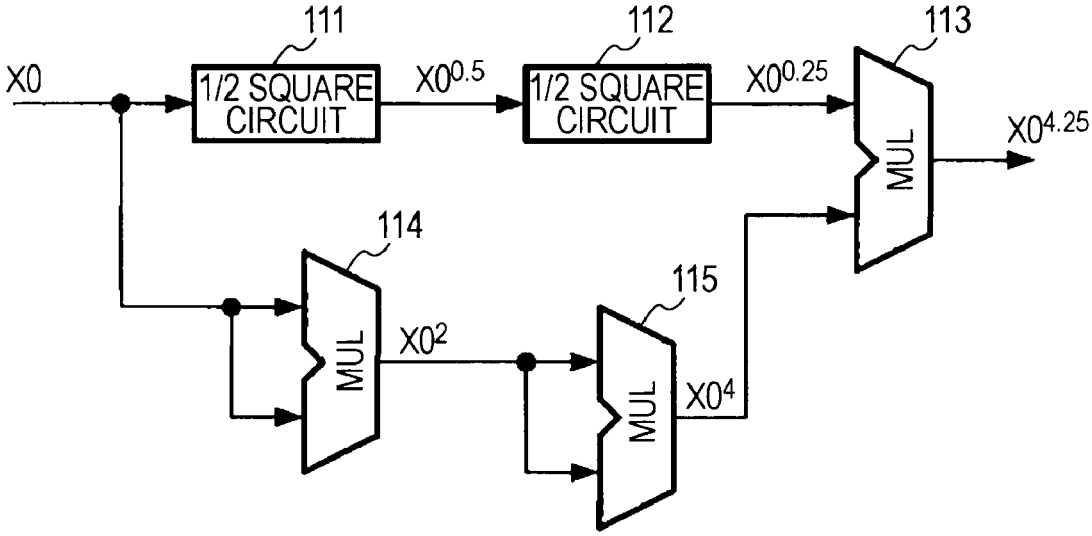
FIG. 10 is a configuration diagram showing another configuration example based on a calculation process of the subpixel drive level calculation unit.

FIG. 10 shows a specific configuration example of the subpixel drive level calculation unit 4 using calculation circuits.

In this example, when the gradation value of the video signal to be input to the timing controller 30 is set as x0 and a calculation result $x_1$ thereof is set as the gradation value of the subpixel B, the calculation of $$x1=x0^{4.25}$$

is performed to obtain the drive level of the subpixel B with respect to the gradation of the input video signal.

The configuration of FIG. 10 will be described. The gradation value x0 of the input video signal is supplied to a ½ square circuit 111, which is a circuit for calculating a square root, whereby $x0^{0.5}$ is obtained. In addition, the output $x0^{0.5}$ of the ½ square circuit 111 is supplied to another ½ square circuit 112, whereby an output $x0^{0.25}$ is obtained. The output $x0^{0.25}$ of the ½ square circuit 112 is supplied to a multiplication circuit 113. Furthermore, the gradation value x0 of the input video signal is supplied to a multiplication circuit 114 so as to obtain a squared output $x0^2$. In addition, the squared output $x0^2$ of the multiplication circuit 114 is supplied to another multiplication circuit 115, whereby a squared output $x0^4$ is obtained, and the output $x0^4$ is supplied to a multiplication circuit 113.

In the multiplication circuit 113, the supplied signal $x0^{0.25}$ and signal $x0^4$ are multiplied to obtain a multiplication output $x0^{4.25}$.

Figure 11:
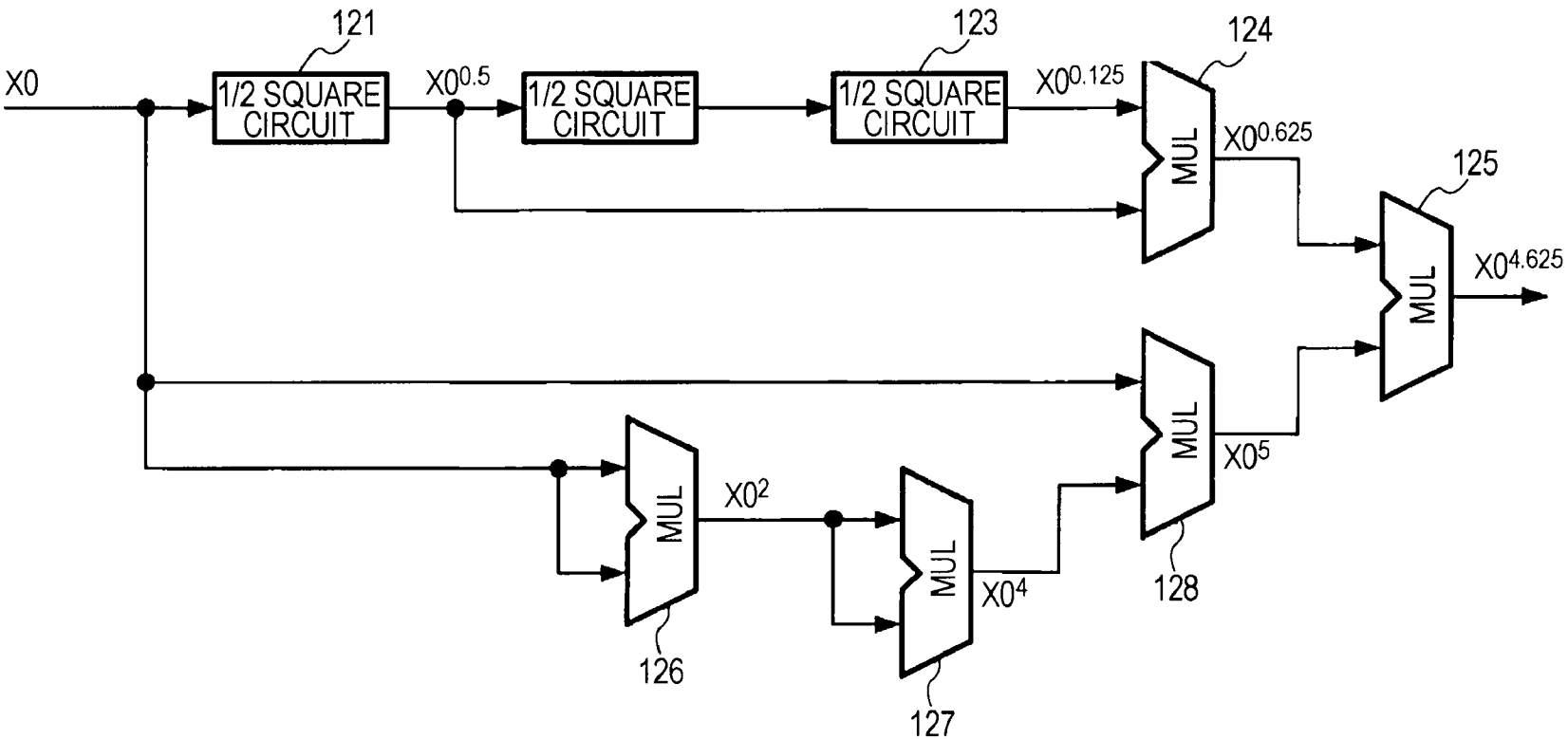
FIG. 11 is a configuration diagram showing still another configuration example based on the calculation process of the subpixel drive level calculation unit.

FIG. 11 shows still another configuration example of the subpixel drive level calculation unit 4 using calculation circuits.

In this example, when the gradation value of the video signal to be input to the timing controller 30 is set as x0 and a calculation result $x_1$ thereof is set as the gradation value of the subpixel B, the calculation of $$x1=x0^{5.625}$$

is performed to obtain the drive level of the subpixel B with respect to the gradation of the input video signal.

The configuration of FIG. 11 will be described. The gradation value x0 of the input video signal is supplied in sequence to ½ square circuits 121, 122, and 123, which are circuits for calculating a square root, whereby an output $x0^{0.125}$ is obtained. Then, the output $x0^{0.5}$ of the ½ square circuit 121 and the output $0^{0.125}$ of the ½ square circuit 123 are supplied to a multiplication circuit 124, whereby a multiplication output $x0^{0.625}$ is obtained. The multiplication output $x0^{0.625}$ of the multiplication circuit 124 is supplied to a multiplication circuit 125.

Furthermore, by using three multiplication circuits 126, 127, and 128, a multiplication output $x0^5$ is obtained from the gradation value x0 of the input video signal. This multiplication output $x0^5$ is supplied to the multiplication circuit 125.

In the multiplication circuit 123, the supplied signal $x0^{0.625}$ and signal $x0^5$ are multiplied together, thereby obtaining a multiplication output $x0^{5.625}$.

Figure 12:
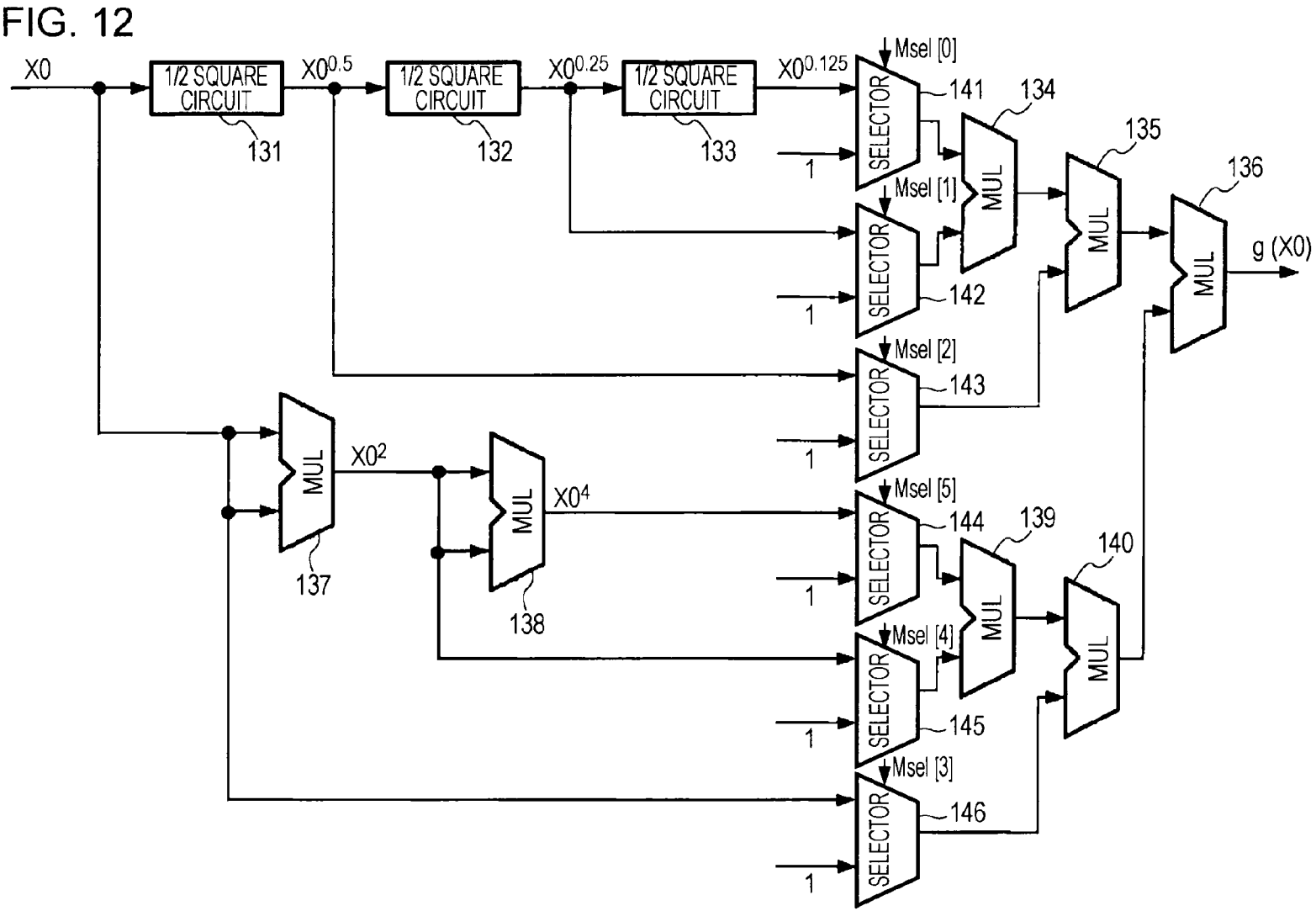
FIG. 12 is a configuration diagram showing a configuration example of a generalized subpixel drive level calculation unit.

FIG. 12 shows a generalized circuit for obtaining an arbitrary multiplier number using such multiplication circuits and square root circuits. This example shows a configuration in which the gradation value of an video signal to be input to the timing controller 30 is set as x0 and a calculation result g(x0) is set as the gradation value of the subpixel B, so that the calculation result g(x0) can be set to an arbitrary multiplier number.

In the configuration of FIG. 12, ½ square circuits 131 to 133, which are circuits for calculating a square root, multiplication circuits 134 to 140, and selectors 141 to 146 are provided. The selectors 141 to 146 are selection means for selecting one of each signal of the multiplier numbers supplied correspondingly from circuits of previous stages and a signal "1". By externally controlling the selected states of the selectors 141 to 146, the multiplier number of the output signal g(x0) is determined.

The configuration of FIG. 12 will be described. The gradation value x0 of an input video signal is supplied in sequence to the ½ square circuits 131, 132, and 133, which are circuits for calculating a square root, and in the respective ½ square circuits 131, 132, and 133, multiplication outputs $x0^{0.5}$, $x0^{0.25}$, and $x0^{0.125}$ are obtained.

The output $x0^{0.125}$ of the ½ square circuit 133 is supplied to the multiplication circuit 134 via the selector 141. The output $x0^{0.25}$ of the ½ square circuit 132 is supplied to the multiplication circuit 134 via the selector 142. In the multiplication circuit 134, the outputs of the selectors 141 and 142 are multiplied, and the multiplication output is supplied to a multiplication circuit 135.

The output $x0^{0.5}$ of the ½ square circuit 131 is supplied to the multiplication circuit 135 via the selector 143. In the multiplication circuit 135, the output of the multiplication circuit 134 is multiplied by the output of the selector 143, and a multiplication output thereof is supplied to a multiplication circuit 136.

Furthermore, the gradation value x0 of the input video signal is supplied to a multiplication circuit 137, whereby a squared output $x0^2$ is obtained. The output $x0^2$ is supplied to a multiplication circuit 138, whereby a further squared output $x0^4$ is obtained. The output $x0^4$ of the multiplication circuit 138 is supplied to a multiplication circuit 139 via the selector 144, and the output $x0^2$ of the multiplication circuit 137 is supplied to the multiplication circuit 139 via the selector 145. In the multiplication circuit 139, the outputs of the selectors 144 and 145 are multiplied, and a multiplication output thereof is supplied to a multiplication circuit 140.

Furthermore, the gradation value x0 of the input video signal is supplied to a multiplication circuit 140 via the selector 146, and in the multiplication circuit 140, the output of the multiplication circuit 139 is multiplied by the output of the selector 146. In addition, the output of the multiplication circuit 140 is supplied to the multiplication circuit 136, and in the multiplication circuit 136, the output of the multiplication circuit 135 is multiplied by the output of the multiplication circuit 140.

As a result of being configured as described above, for the multiplication output g(x0) of the multiplication circuit 136, any desired power multiplier number can be selected on the basis of the selected state in the selectors 141 to 146. For example, the configuration can be arranged as the subpixel drive level calculation unit shown in FIG. 10, and can also be configured as the subpixel drive level calculation unit shown in FIG. 11. It is possible to freely determine the configuration so that a necessary drive level of a subpixel is obtained.

Figure 13:
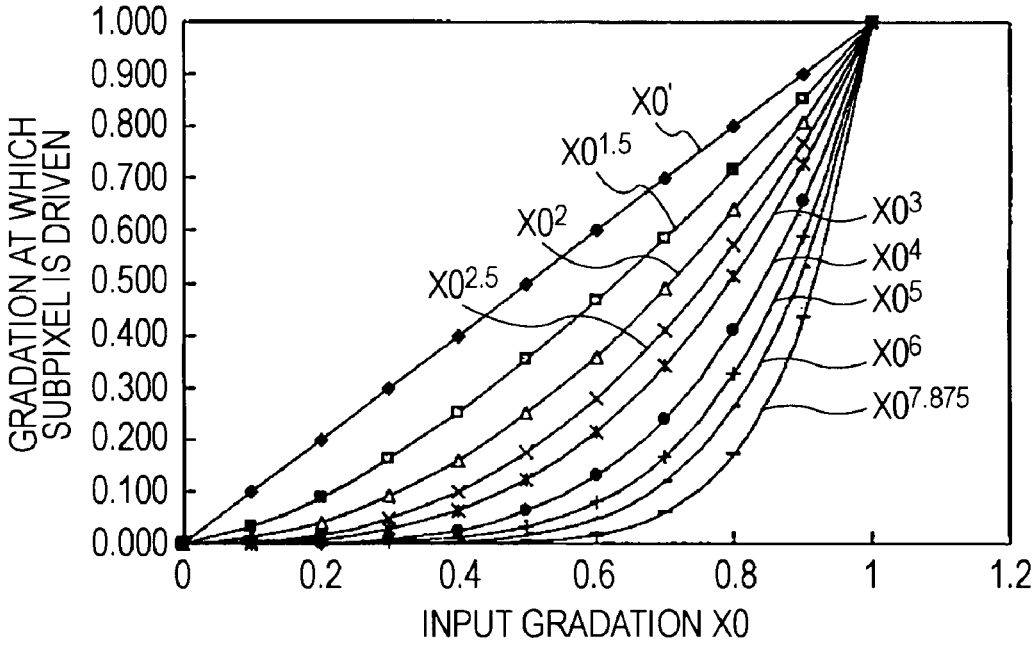
FIG. 13 is a characteristic view showing an example of changes of the drive level of the subpixel B on the basis of the configuration of FIG. 12.

FIG. 13 shows a characteristic example of an input gradation x0 and a gradation at which the subpixel B is driven, which is an output gradation, in a case where a power multiplier number is changed in the configuration of FIG. 12. An example is shown in which the characteristics are a straight line when the power multiplier number is set at $x0^1$ and in the state, the power multiplier number is changed to $x0^{1.5}$, $x0^2$, $x0^{2.5}$, $x0^3$, $x0^4$, $x0^5$, $x0^6$, and $x0^{7.875}$.

As can be seen from FIG. 13, it is possible to freely change the characteristics by changing the processing state in one subpixel drive level calculation unit.

<Configuration Example of Subpixel Drive Level Calculation Unit 4 Using LUT>

Figure 14:
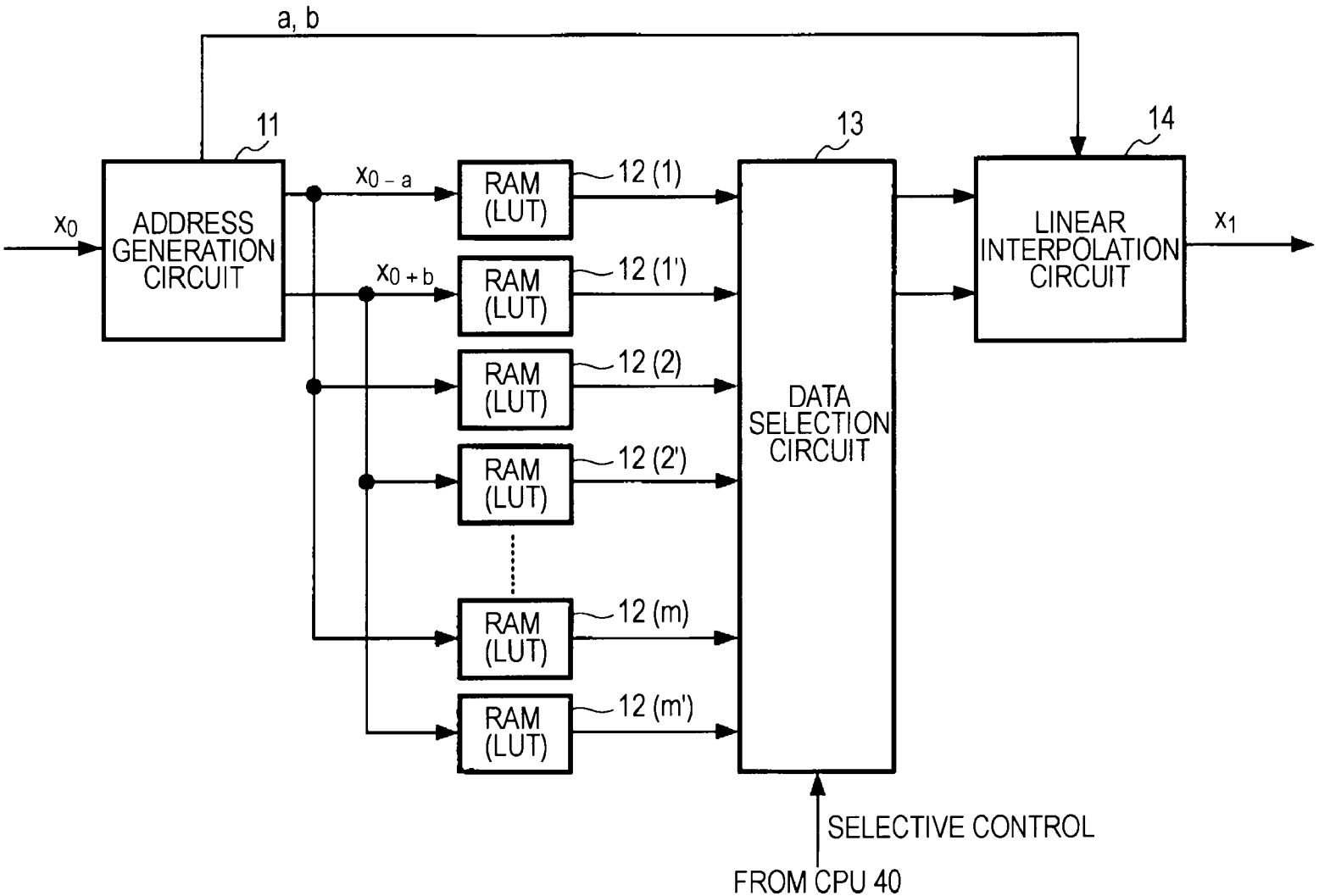
FIG. 14 is a block diagram showing a configuration example in which an LUT of the subpixel drive level calculation unit is used.

As shown in FIG. 14, an address generation circuit 11, a plurality of sets, each set being formed of two RAMs, of RAMs 12 (RAMs 12 (1) and 12 (1'), 12 (2) and 12 (2'), . . . 12 (*m*) and 12 (*m'*)), a data selection circuit 13, and a linear interpolation circuit 14 constitute the subpixel drive level calculation unit 4.

The RAMs 12 of each set are each stored with a look-up table in which discrete gradation values of an input video signal (gradation values more coarse than the resolution of the actual gradation in the liquid-crystal display device) are associated with the gradation values of the subpixel B, and the driving level with respect to the input video signal is made different for each set (the drive levels are made equal in the two RAMs of the same set).

Figure 4:
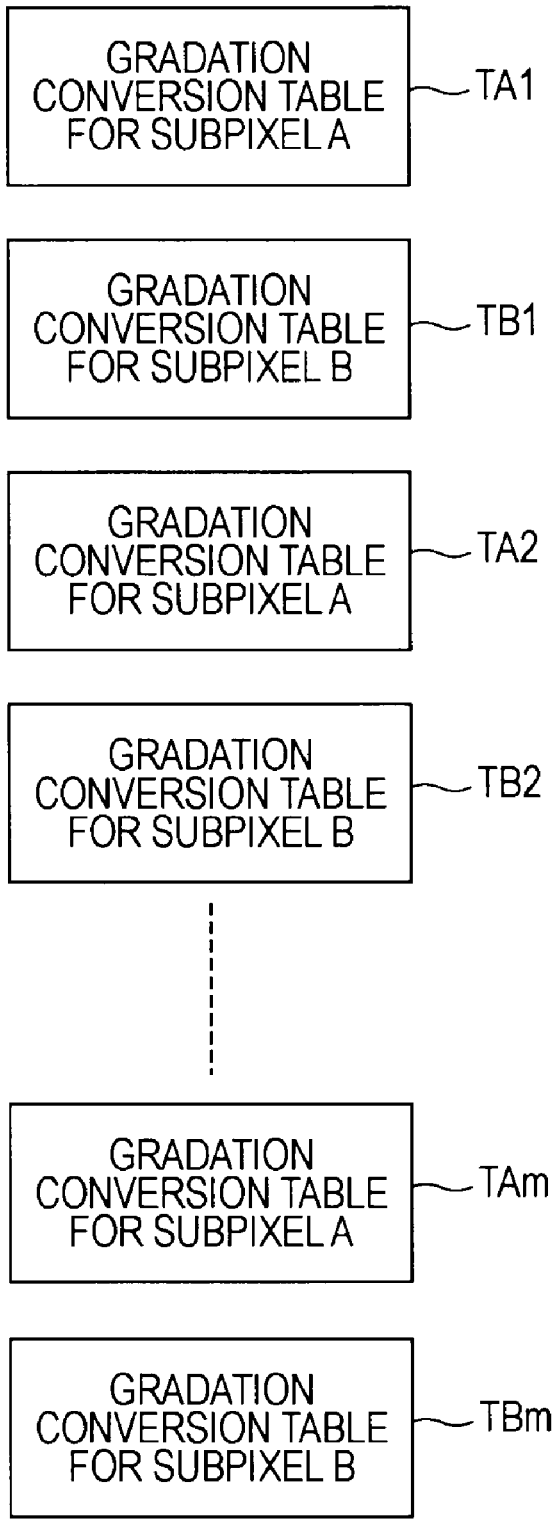
FIG. 4 is a configuration diagram showing an example in which many gradation conversion tables are provided.

Although these look-up tables are the same as the gradation conversion table described with reference to FIG. 4 in that input gradations and output gradations are associated with each other, since only discrete gradation values are stored, it is possible to suppress an increase in the circuit scale even if a plurality of look-up tables are provided.

The address generation circuit 11 is a circuit for generating, as reference addresses, two gradation values x0−a and x0+b, with the gradation value x0 of the input video signal being held therebetween in the look-up table in the RAM 12.

The reference address x0−a generated by the address generation circuit 11 is supplied to the one side (the RAMs 12 (1), 12 (2), . . . 12 (*m*)) of the RAMs 12 of each set. The reference address x0+b generated by the address generation circuit 11 is supplied to the other side (the RAMs 12 (1'), 12 (2'), . . . 12 (*m'*)) of the RAMs 12 of each set.

The gradation values read from the look-up tables in the RAMs 12 of each set on the basis of the reference addresses x0−a and x0+b are sent to the data selection circuit 13.

The data selection circuit 13 is a circuit for selecting gradation values from one set of RAMs from among a plurality of sets of RAMs (two gradation values corresponding to the reference addresses x0−a and x0+b, respectively). In the case of this configuration example, the CPU 40 (FIG. 5) supplies, to the data selection circuit 13, a control signal that specifies the set of the RAMs 12 to be selected.

The linear interpolation circuit 14 is a calculation circuit for performing linear interpolation on two gradation values selected by the data selection circuit 13 on the basis of the ratio of the value a to the value b, which are used for the address generation circuit 11 to generate the reference addresses, and the interpolation result of the linear interpolation circuit 14 is set as the gradation value x1 of the subpixel B.

Also, in this configuration example, by switching the selections in the data selection circuit 13, it is possible to change the drive level of the subpixel B with respect to the gradation value x0 of the input video signal in two or more ways similarly to that shown as an example in FIG. 9.

As shown in FIG. 6, the gradation value x0 of the video signal that is input to the timing controller 30 from the video signal processing circuit 20 (FIG. 5) is supplied as a reference address to the RAM 1. The luminance value f(x0) (the luminance value corresponding to the gradation value x0 in the target characteristics GL of FIG. 7) read from the look-up table in the RAM 1 on the basis of the reference address x0 is sent to the subtraction circuit 5.

Furthermore, this gradation value x0 of the input video signal is also supplied to the subpixel drive level calculation unit 4. The gradation value x1 of the subpixel B, which is calculated by the subpixel drive level calculation unit 4 in such a manner as to correspond to the gradation value x0, is output from the timing controller 30 and is sent to the data driver 60 (FIG. 5), and is also supplied as a reference address to the RAM 3.

The luminance value f(x1) (the luminance value corresponding to the gradation value x1 in the gradation-luminance characteristics GLB of FIG. 7) read on the basis of the reference address x1 from the look-up table inside the RAM 3 is sent to the subtraction circuit 5.

The subtraction circuit 5 subtracts the luminance value f(x1) from the luminance value f(x0), and supplies a subtraction result f(x2)=f(x0)−f(x1) as a reference address to the RAM 2. The gradation value x2 (the gradation value corresponding to the luminance value f(x2) in the gradation-luminance characteristics GLA of FIG. 7) read from the look-up table inside the RAM 2 on the basis of the reference address f(x2) is output from the timing controller 30 and is sent to the data driver 60.

On the basis of the gradation values x1 and x2 sent from the timing controller 30, the data driver 60 (FIG. 5) drives the subpixels B and A (FIG. 1) among the pixels P of the liquid-crystal panel 50, respectively.

In the liquid-crystal display device, if the calculation result of the gradation value x1 of the subpixel B by the subpixel drive level calculation unit 4 in the timing controller 30 is changed only under the control of the CPU 40, since the luminance value f(x1) sent from the RAM 3 to the subtraction circuit 5 is changed, the reference address f(x2) supplied from the subtraction circuit 5 to the RAM 2 is changed. Therefore, it is possible to change the drive levels of the subpixels A and B with respect to the gradation of the video signal to be input to the timing controller 30.

Figure 15:
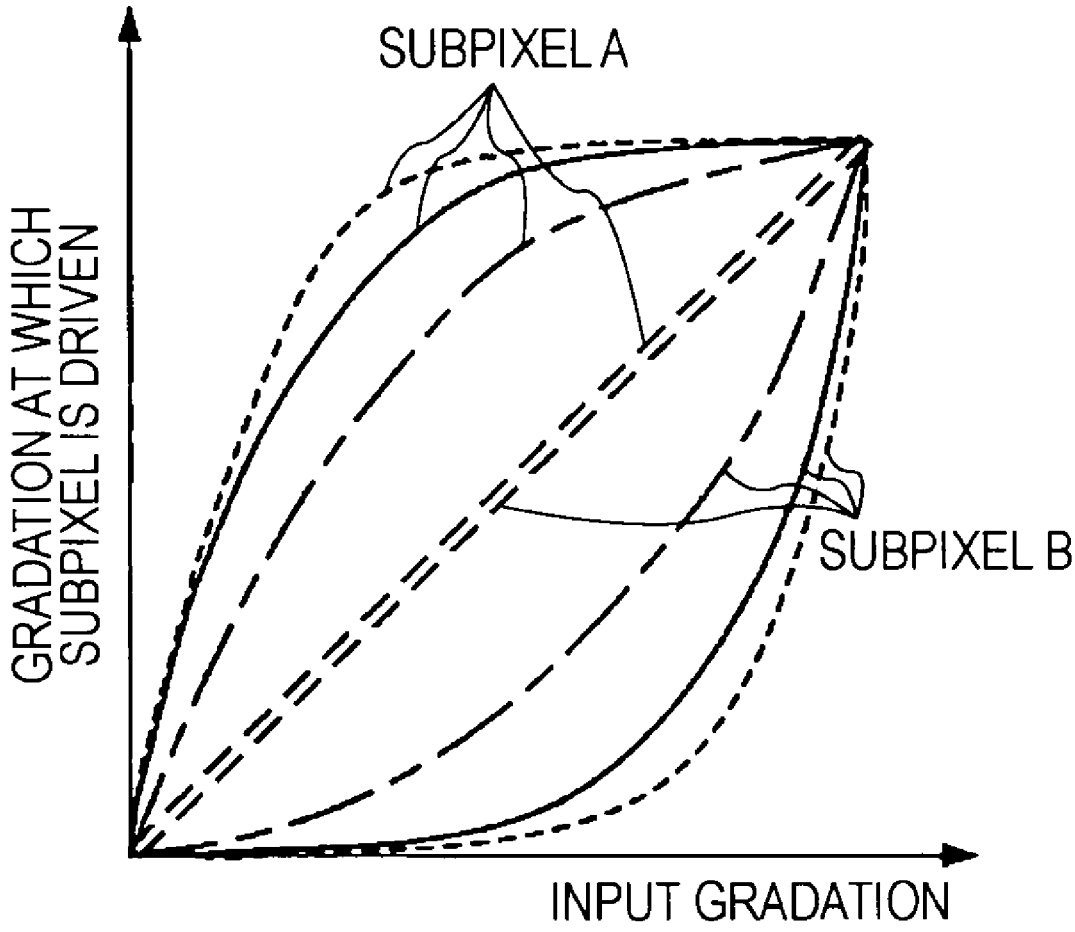
FIG. 15 is a characteristic view showing as an example a state of changes of drive levels of subpixels on the basis of the circuit of FIG. 6.

FIG. 15 shows a state of changes in the drive levels of the subpixels A and B using the circuit of FIG. 6 by using, as an example, a case in which the drive level of the subpixel B is changed as shown in FIG. 9 by the subpixel drive level calculation unit 4.

As described above, in the liquid-crystal display device, it is possible to increase the number of selectable drive levels of the subpixels A and B by only increasing variations of the calculation result by the subpixel driving the level calculation unit 4 while the number of RAMs in which gradation-luminance characteristics of the whole pixels P, the subpixel A, and the subpixel B are stored as look-up tables, is fixed to three, that is, the RAMs 1 to 3.

Figure 2A:
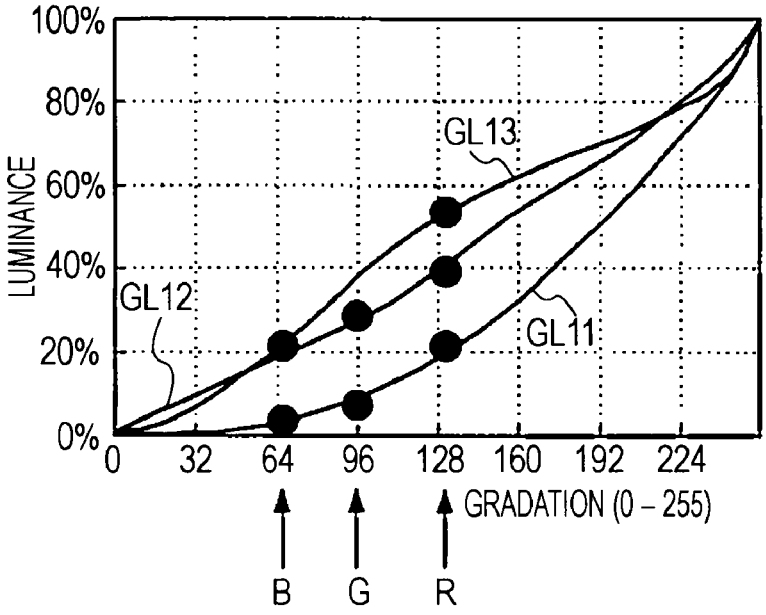
FIG. 2 includes characteristic views showing examples in which drive levels of subpixels are changed on the basis of the pixels of R, G, and B.
Figure 2B:
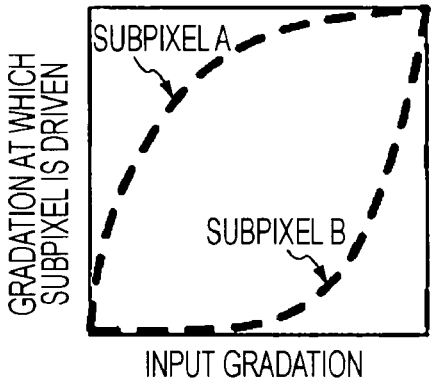
Figure 2C:
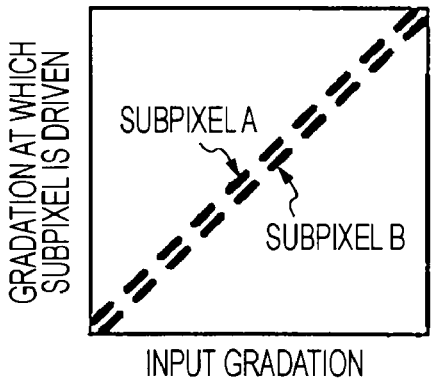

As a result, in the liquid-crystal display device, it is possible to select (for example, the driving level is selected from among a plurality of drive levels in accordance with whether the pixel is R, G, or B as shown in FIG. 2, or the drive level of the subpixel is selected from among a plurality of drive levels in accordance with the type of the input video signal) the drive level of a subpixel with respect to the gradation of the input video signal from among a plurality of drive levels while an increase in the circuit scale is suppressed.

Furthermore, in a method of providing only a gradation conversion table in which the gradation of an input video signal and output gradations for each subpixel are associated with each other as described in the document (Japanese Unexamined Patent Application Publication No. 2005-316211) given in the Background Art, there are cases in which target gradation-luminance characteristics cannot be realized with high accuracy. However, in the liquid-crystal display device, it is possible to realize target gradation-luminance characteristics with high accuracy by increasing variations of the calculation result by the subpixel drive level calculation unit 4 inside the timing controller.

Further, in the above examples, as shown in FIG. 6, the RAM 1, the RAM 2, and the RAM 3 are provided, and these RAMs are each stored with a look-up table in which gradation values and luminance values are associated with each other so that the target characteristics GL, the gradation-luminance characteristics GLA, and the gradation-luminance characteristics GLB shown in FIG. 7 are shown. However, not being limited to such RAMs, appropriate means (for example, a calculation circuit for generating, as a result of one of the gradation value and the luminance value being supplied, the value of the other on the basis of calculation, or the like) for generating information on the correspondence between gradations and luminances for realizing target characteristics GL, gradation-luminance characteristics GLA, and gradation-luminance characteristics GLB may be provided.

Explanation of Reference Numerals

1: RAM, 2: RAM, 3: RAM, 4: subpixel drive level calculation unit, 5: subtraction circuit, 10: calculation circuit, 11: address generation circuit, 12 (1) and 12 (1'), 12 (2) and (2'), 12 (*m*) and 12 (*m'*): RAM, 13: data selection circuit, 14: linear interpolation circuit, 20: video signal processing circuit, 30: timing controller, 40: CPU, 50: liquid-crystal display panel, 60: data driver, 70: gate driver, 111, 112, 121, 122, 123, 131, 132, 133: ½ square circuit, 113, 114, 115, 124, 125, 126, 127, 128, 134, 135, 136, 137, 138, 139, 140: multiplication circuit, 141, 142, 143, 144, 145, 146: selector

The invention claimed is:

1. A liquid-crystal display device comprising:

a liquid-crystal display panel in which each of pixels is divided into a first subpixel and a second subpixel;

a driving circuit for driving the liquid-crystal panel; and a drive control circuit for controlling the driving of the liquid-crystal display panel by using the driving circuit, wherein the drive control circuit includes a first subpixel driving level converter for, on the basis of the gradation value of each pixel of an input video signal, obtaining a first gradation value for driving the first subpixel of the liquid-crystal display panel, a first luminance value converter for converting a gradation value for driving the first subpixel, the gradation value being converted by the first subpixel driving level converter, into a luminance value, a second luminance value converter for converting the gradation value of each pixel of the input video signal into a luminance value, a subtraction unit for calculating a difference between the luminance value converted by the second luminance value converter and the luminance value converted by the first luminance value converter, and a second subpixel driving level converter for converting the luminance value of the difference subtracted by the subtraction unit into a gradation value and obtaining a second gradation value for driving the second subpixel of the liquid-crystal display panel, the second gradation value for driving the second subpixel being obtained by selecting a subset of a plurality of multiplication circuits that perform distinct power calculations on the gradation value using a single value of n, the power calculations using powers of the single value of n, which is specified by a control signal from a processor, wherein at least the second gradation value is used to achieve a target characteristic for at least one of the pixels.

2. The liquid-crystal display device according to claim 1, wherein the first subpixel driving level converter includes a calculation circuit for multiplying the gradation value of the input video signal and a calculation circuit for obtaining a square root.

3. The liquid-crystal display device according to claim 1, wherein each of the first luminance value converter, the second luminance value converter, and the second subpixel driving level converter includes a storage unit having stored therein a look-up table in which gradation values and luminance values are associated with each other.

4. The liquid-crystal display device according to claim 1, wherein the first subpixel driving level converter includes a storage unit having stored therein look-up tables in which drive levels with respect to the input video signal are made different for each set of look-up tables, two of the look-up tables forming one set, in which discrete gradation values of the input video signal and the gradation values of the one subpixel are associated with each other;

an address generator for, with respect to the gradation value of the input video signal, generating, as reference addresses, two gradation values with the gradation value being held therebetween in the look-up table;

a selector for selecting gradation values from one of the sets of look-up tables among the gradation values read from the look-up tables of the respective sets on the basis of the reference addresses; and an interpolation unit for interpolating the gradation values selected by the selector.

5. The liquid-crystal display device according to claim 1, wherein a sum of the luminance value for the first subpixel and a luminance value of the second subpixel is equal to a luminance value of the target characteristic, which corresponds to the gradation value.

6. A drive control circuit comprising:

a first subpixel driving level converter for obtaining, on the basis of a gradation value of each of pixels of an input video signal, a first gradation value for driving a first subpixel among the first and second subpixels arranged in each pixel of a liquid-crystal display panel;

a first luminance value converter for converting a gradation value for driving the first subpixel, the gradation value being converted by the first subpixel driving level converter, into a luminance value;

a second luminance value converter for converting the gradation value of each pixel of the input video signal into a luminance value;

a subtraction unit for calculating a difference between the luminance value converted by the second luminance value converter and the luminance value converted by the first luminance value converter; and a second subpixel driving level converter for converting the luminance value of the difference subtracted by the subtraction unit into a gradation value and obtaining a second gradation value for driving the second subpixel, the second gradation value for driving the second subpixel being obtained by selecting a subset of a plurality of multiplication circuits that perform distinct power calculations on the gradation value using a single value of n, the power calculations using powers of the single value of n, which is specified by a control signal from a processor, wherein at least the second gradation value is used to achieve a target characteristic for at least one of the pixels.

7. The drive control circuit according to claim 6, wherein the first subpixel driving level converter includes a calculation circuit for multiplying the gradation value of the input video signal and a calculation circuit for obtaining a square root.

8. The drive control circuit according to claim 6, wherein each of the first luminance value converter, the second luminance value converter, and the second subpixel driving level converter includes a storage unit having stored therein a look-up table in which gradation values and luminance values are associated with each other is stored.

9. The drive control circuit according to claim 6, wherein the first subpixel driving level converter includes a storage unit having stored therein look-up tables in which drive levels with respect to the input video signal are made different for each set of look-up tables, two of the look-up tables forming one set, in which discrete gradation values of the input video signal and the gradation values of one of the subpixels are associated with each other;

an address generator for generating, as reference addresses, two gradation values with the gradation value being held therebetween in the look-up table with respect to the gradation value of the input video signal;

a selector for selecting gradation values from one of the sets of look-up tables among the gradation values read from the look-up tables of the respective sets on the basis of the reference addresses; and an interpolation unit for interpolating the gradation values selected by the selector.

10. The drive control circuit according to claim 6, wherein a sum of the luminance value for the first subpixel and a luminance value of the second subpixel is equal to a luminance value of the target characteristic, which corresponds to the gradation value.

* * * * *